United States Patent [19]

Martindale et al.

[11] 4,360,125

[45] Nov. 23, 1982

[54] MEDICATION INVENTORY DEVICE

[75] Inventors: Diane S. Martindale, Plymouth; Dennis G. Hepp, Coon Rapids, both of Minn.

[73] Assignee: Medtronic, Inc., Minneapolis, Minn.

[21] Appl. No.: 128,931

[22] Filed: Mar. 10, 1980

[51] Int. Cl.[3] ..... A47B 67/02

[52] U.S. Cl. ..... 221/2; 221/15; 364/569

[58] Field of Search ..... 221/2–5, 221/8, 9, 15; 235/91 D, 92 T, 144 ET; 364/569

[56] References Cited

U.S. PATENT DOCUMENTS

| | | | |
|---|---|---|---|
| 3,762,601 | 10/1973 | McLaughlin | 221/2 |
| 3,795,343 | 3/1974 | Shigemori et al. | 221/2 |
| 4,065,663 | 12/1977 | Edwards | 364/569 X |
| 4,168,525 | 9/1979 | Russell | 364/569 |

*Primary Examiner*—Robert J. Spar
*Assistant Examiner*—Edward M. Wacyra
*Attorney, Agent, or Firm*—Schroeder, Siegfried, Vidas, Steffey & Arrett

[57] ABSTRACT

A medication dispenser in which medication to be dispensed is housed, including a member operable to allow medication access. The dispenser provides a medication alert signal at preselected times in accordance with a desired medication regimen. A medication access signal is provided when medication access is obtained. Data representative of the relative timing between a medication alert signal and a medication access signal is written into a readable memory whereby that data is available to a physician for evaluation. In a preferred embodiment, the data is representative of the time of occurrence of each medication alert signal and medication access signal. The interval between medication alert signals is selectively alterable.

9 Claims, 1 Drawing Figure

MEDICATION INVENTORY DEVICE

DESCRIPTION

BACKGROUND OF PRIOR ART

Dispensers for medications, such as pills, are known to the prior art. Such dispensers have been employed for one or more purposes including: alerting the patient or medical personnel as to the desired timing of medication administration; indicating that a particular medication dosage has been administered; and preventing the administration of a medication overdose.

One prior art medication dispenser is shown in U.S. Pat. No. 3,369,697 issued Feb. 20, 1968, to Jay Glucksman et al for PROGRAMMED MEDICATION DISPENSER. The Glucksman dispenser is a timed dispenser which dispenses medication at preselected time intervals. A timer actuates a control system which, at selected intervals, allows passage of desired medication dosage to a delivery station. The timer is then deactivated till the dose is removed from the delivery station. In this manner, dosages cannot accumulate at the delivery station and the patient is positively prevented from inadvertently obtaining excessive dosages within an unduly short period of time. A light is employed to signal the presence of a dose within the delivery station.

A similar system is illustrated in U.S. Pat. No. 3,968,900 issued July 13, 1976, to Stambuck for TIMED MEDICANT DISPENSING DEVICE in which preselected dosages are contained within a ball. The balls are housed within a dispenser and are delivered to a dispenser tray at preselected intervals. An electrically operated alarm audibly notifies the patient to remove the balls from the tray and the alarm continues to operate until the balls are removed. The clock drive employed by the device is de-energized until the balls are removed. As a result, a patient cannot take the medication more often than the time intervals that have been preselected.

Dispensing systems intended for use by medical personnel are disclosed in U.S. Pat. No. 3,762,601 issued Oct. 2, 1973, to McLaughlin for CABINET FOR DISPENSING MEDICINES AT PREDETERMINED TIMES and U.S. Pat. No. 3,998,356 issued Dec. 21, 1976, to Christensen for ELECTRONIC SYSTEMS FOR ARTICLE DISPENSING APPARATUS. In each of these systems, individually controlled compartments are allowed to be opened only at preselected times during the course of a day. Thus, access to the medication is restricted and, accordingly, the possibility of an overdose is reduced.

In addition to the above, various mechanical systems that indicate, on a daily basis, that medication has or has not been taken are known to the prior art. Representative examples are disclosed in U.S. Pat. Nos. 3,584,598 issued June 15, 1971, to Gayle et al for PILL DISPENSER WITH INDICATING MEANS and 4,126,247 issued Nov. 21, 1978, to Majka for PILL DISPENSER. Each of these devices contain a plurality of pills and provide a visual indication as to whether a particular pill intended for a particular day has, in fact, been dispensed.

BRIEF SUMMARY OF THE INVENTION

The present invention provides a medication dispenser which houses the medication to be dispensed. A door or similar member allows access to the medication. Operation of the member by which medication access is obtained provides a medication access signal. In addition, a medication alert signal is provided at preselected times with the relative timing between a medication alert signal and a medication access signal being written into a readable memory. In this manner, a record is established by which a patient's adherence to a particular medication regimen can be readily determined. In a preferred embodiment, the data written into the readable memory is representative of the time of occurrence of each medication alert signal and medication access signal as well as the number of days elapsed in a medication regimen being dispensed. The interval between medication alert signals is selectively alterable and the dispenser may independently house a plurality of medications with access to one or more of such medications providing a medication access signal.

BRIEF DESCRIPTION OF THE DRAWING

The single FIGURE illustrates a logic system employed in a preferred embodiment of the present invention.

DETAILED DESCRIPTION OF THE INVENTION

General

Figure 1:
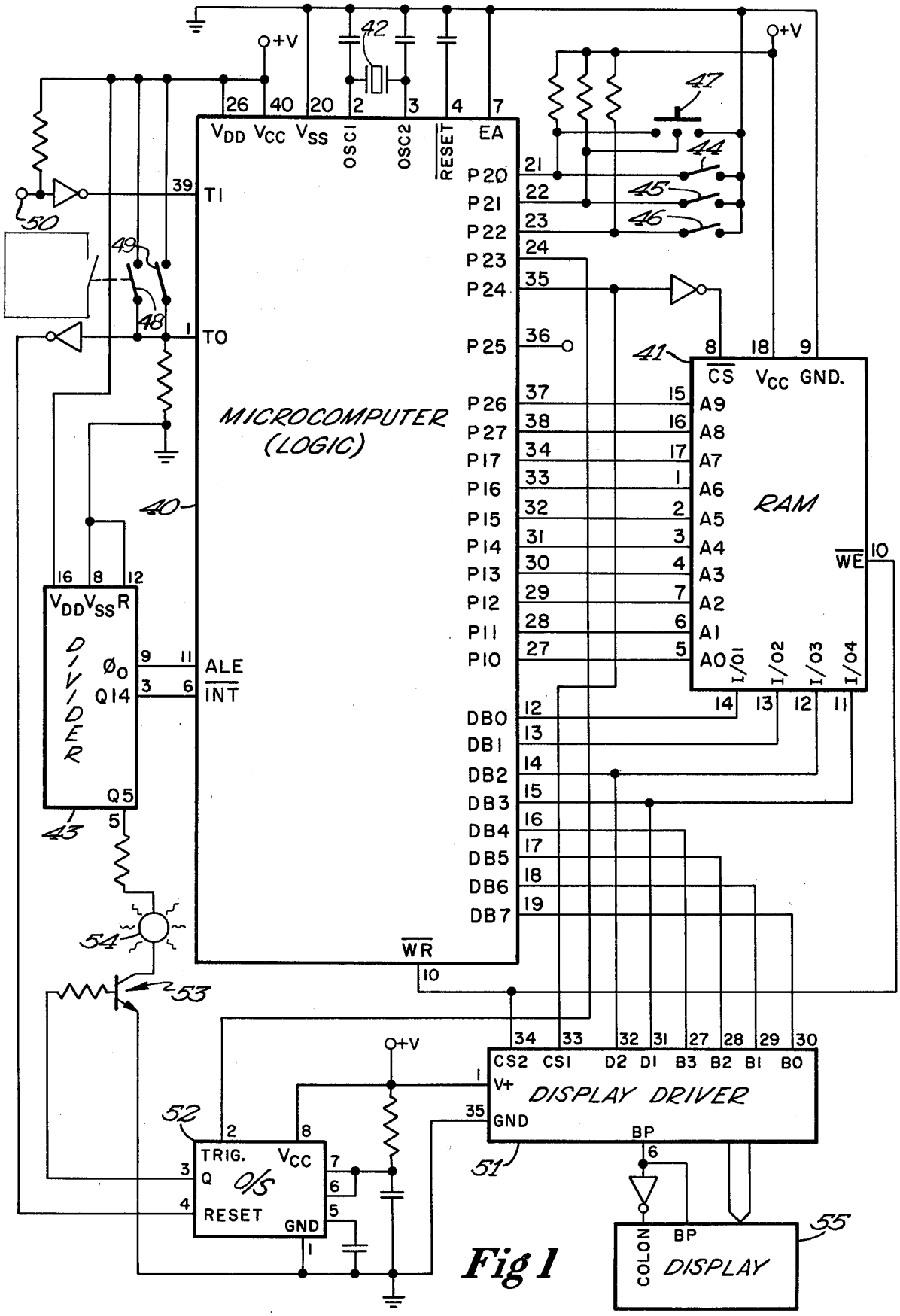

The single FIGURE shows a number of commercially available functional circuits shown in block form with the pin designations specified by the manufacturer. The preferred circuits are identified below by the manufacturer's designations although functionally equivalent circuits may be available from others under different identification numbers. Also, in addition to the explicit identification of pin numbers on the commercial circuit elements, one or more alpha-numeric characters describing the function of those pins are also indicated within the outlines of the circuits. These alpha-numeric descriptive terms generally correspond to those used by the manufacturers of the circuits. Although the illustrated embodiment illustrates an implementation of a preferred embodiment of the present invention employing a microcomputer, it is to be understood that the present invention could be alternatively implemented with conventional logic elements without departing from the scope and spirit of the invention.

The present invention is directed to a dispensing system and particularly a medication dispensing system which provides a medication alert output in accordance with a desired medication regimen. The alert output may be made by way of a visual signal. However, the alert output is preferably audible so as to be detectable even when the dispenser is not in sight.

On detection of the alert output, it is intended that the patient, or some other party assisting the patient, obtain access to the medication as by opening a door to a compartment which houses the medication. Opening of the door toggles a switch and results in an input signal to the control logic that may be designated as the medication access signal. The relative timing of the medication alert signal and medication access signal are written into a readable memory to provide a record as to how closely the desired medication regimen has been followed. In a preferred embodiment, the dispenser of the present invention includes a visual time display with the stored data being representative of the time of each medication alert signal and medication access signal. The stored data may also include data representative of the number of days elapsed in the medication regimen being dispensed. The alert signal timing may be altered to accommodate varying medication regimens.

The control logic may limit access to the medication as by restricting access to the medication housing container except during a predetermined interval following a medication alert signal. The medication alert output may be terminated on obtaining access to the medication during the usual duration of the medical alert output. Also, a plurality of medications may be independently contained with access to one or more resulting in a medication access signal.

Control Logic

The control logic for the present invention is provided by a microcomputer 40 and its control program which is stored within the microcomputer 40 memory. In a preferred embodiment, the microcomputer is an Intersil IM87C48 CMOS single chip microcomputer. This microcomputer combines with a processing unit both ROM and RAM memory as well as a counter/-timer. Additional memory is provided by RAM 41 which is preferably an NEC UPD444/6514 static CMOS RAM, the operative interconnections between RAM 41, the microcomputer 40 and the power supply being fully illustrated in the FIGURE.

The clock for the microcomputer 40 is provided by a crystal 42 which is connected to the OSC 1 and OSC 2 inputs at pins 2 and 3, respectively. A second clock pulse is provided to microcomputer 40 via the INT input at pin 6 from a divider 43, the divider 43 being discussed more fully below. Normally open switches 44–46 connect the P20–P22 inputs at pins 21–23 to ground while a connection illustrated as a normally open pushbutton switch 47 connects pins 21 and 22 to ground. Normally open switches 48 and 49 connect the positive voltage supply to input T0 at pin 1 while an inverter connects a terminal 50 to input T1 at pin 39. Output ALE provides clock pulses to the input of divider 43 at pin 9 while output WR of microcomputer 40 is connected to input WE, both at pin 10 of the respective circuits, to strobe data into RAM 41, in known manner. Pin 10 of microcomputer 40 is also connected to input CS 2 at pin 34 of a display driver 51, the display driver 51 being described more fully below.

Medication Alert Output

The medication alert output is provided primarily by divider 43, one-shot 52, transistor 53 and a piezoceramic chip 54. The piezoceramic chip 54 is connected to that output of divider 43 that will provide an output of approximately 2 KHz. With a 1 MHZ clock frequency established by crystal 42, and the divider identified below, this output is Q5 at pin 5. The piezoceramic chip 54 is connected between the output of divider 43 and the collector of transistor 53, the emitter of transistor 53 being connected to ground. The base of transistor 53 is connected, via a resistor, to the Q terminal of one-shot 52. The reset input of one-shot 52 is connected at pin 4 to the switches 48 and 49 via an inverter while P23 at pin 24 of microcomputer 40 is connected to the trigger input of one-shot 52 at pin 2. The components connected to pins 5–7 of one-shot 52 establish its output duration, in known manner. In a preferred embodiment, one-shot 52 may be implemented with an Intersil 555 type precision timer.

Divider 43 may be formed of an RCA CD4060A type integrated circuit. In addition to the connections discussed above, pin 16 is connected to a positive voltage supply while pins 8 and 12 are connected to ground. An output of divider 43 (output Q5 in the illustrated embodiment) will provide a driving signal to the piezoceramic chip 54 in known manner. On the turn on of transistor 53, the piezoceramic chip 54 will provide an audible signal that is intended to function as a medication alert output as described more fully below.

Visual Time Display

A visual time display is provided by a liquid crystal display 55 driven in conventional manner by a display driver 51. In a preferred embodiment, display 55 is an AND model FE0203 liquid crystal display while display driver 51 is an Intersil ICM7211 (A)M four-digit display decoder-driver. The operative inputs of display driver 51 and their interconnection to microcomputer 40 are as illustrated in the FIGURE.

Operation

As noted above, the medication to be dispensed is contained within a housing having a member operable to provide access to the medication within the housing. Such a member may take the form of a door, either pivoted or sliding. In any event, each such access member may have associated therewith a normally open switch such as those illustrated at 48 and 49 in the FIGURE. A housing having a single access member associated with switch 48 is diagrammatically illustrated in the FIGURE. On operation of the member, the switch closes to provide an input to input T0 of microcomputer 40 as well as to provide a reset signal to the one-shot 52. In the event that a medication alert output is in process, resetting of the one-shot 52 results in a termination of the alert output by causing a turn off of transistor 53. As is evident from the FIGURE, one or more medication containers may be employed with one or more of them independently providing an input to input T0 of microcomputer 40. The container design may take any convenient form and the medication may be packaged in any desired manner consistent with the purposes of the present invention.

The system illustrated in the FIGURE has a power on reset. That is, the memory is cleared by disconnecting the power supply. The system is initialized by connecting the power supply. Alternatively, a shunt having a normally open switch may be applied across the capacitor connected to the reset input at pin 4 of microcomputer 40, the closing of the switch also serving to initialize the system of the present invention.

After system initialization, the control logic of microcomputer 40 will allow a setting of the time display 55 by operation of the switches 44 and 45. For example, closing of switch 44, through the action of the control logic of microcomputer 40, will cause the hour display to advance until a desired hour is displayed. At that time, switch 44 may be released. Similarly, the closing of switch 45 will cause the minute display to advance until the desired time is displayed. After the time has been set, the desired medication regimen may be established as by closing switch 46. On closing of switch 46, the control logic of microcomputer 40 will cause the display 55 to advance from an initial state. When the desired medication interval is displayed, the switch 46 may be opened with the medication interval being then established. With the time and medication interval established, the control logic of microcomputer 40 will continually update the time display 55.

When the established medication interval has elapsed, the control logic will provide an output at P23 (pin 24) to trigger one-shot 52 and result in a medication alert output. This triggering signal may be referred to as a medication alert signal. As noted above, access to the medication compartment during a medication alert output will result in its termination. In any event, access to a medication compartment will result in an input at input T0. The control logic of microcomputer 40 will write into the memory of RAM 41 the relative timing between the medication alert signal and the medication access signal produced by a closing of one of switches 48 or 49. That is, the time of occurrence of each medication alert signal and each medication access signal will be written into the memory of RAM 41. In addition, data representative of the number of days that have elapsed since initialization of the system will be written into the memory of RAM 41 with the data representative of the medication alert and access signals. Thus, the data stored in the memory of RAM 41 contains information as to the day and time of a medication alert signal as well as the day and time of a medication access signal so as to allow a comparison therebetween to establish how closely the desired medication regimen has been followed.

The stored medication regimen compliance data may be read out in any desired manner. In a preferred embodiment, this data, in the memory of RAM 41, is printed by an external printer. On connection of the external printer, both of switches 44 and 45 are shorted which is represented in the FIGURE by the closing of switch 47. This causes the control logic of microcomputer 40 to enter a sub-routine for the recall of the data and the processing of that data into a proper output format. Output P25 (pin 36) serves as a printer strobe. When it goes low, the printer gives an acknowledge signal on the terminal 50. Thereafter, the control logic of the microcomputer 40 puts the coded output on the terminals of Part 1 of the microcomputer 40 (P10–P17 corresponding to pins 27–34). The printer responds accordingly and provides the printed record described above.

With the above operational disclosure and the illustrated circuit interconnections, it is within the skill of one ordinarily skilled in the art to implement the present invention. To facilitate that implementation, a control program that will provide the described control logic in conjunction with microcomputer 40 is attached hereto as Table 1. Of course, many variations and modifications of the present invention are possible in light of the above teachings. For example, the control logic may be implemented so as to not provide a medication alert output during the nighttime but to resume that output at a preselected time each morning. Also, it is intended that the dispenser unit be hand held. However, a dispenser of any dimension may be fabricated in accordance with the present teaching. In addition, while disclosed in the context of a medication dispenser, the teachings of the present invention have application beyond the dispensing of medications. Further, an external recorder may be easily eliminated by employing the output display to play back the recorded data. The display may also be employed to selectively display the elapsed time since the last medication alert or access signal or the time remaining until the next medication alert signal. It is therefore to be understood that, within the scope of the appended claims, the invention may be practiced otherwise than as specifically described.

We claim:

1. In a medication dispenser of the type having means for housing medication to be dispensed, including means operable to allow medication access, and means for providing medication alert signals at preselected times in accordance with a desired medication regimen, the improvement for determining adherence to said desired medication regimen wherein said access allowing means comprises means for providing a signal when medication access is obtained and further comprising readable memory means and logic means for providing data signals representative of the time of each of said medication alert and medication access signals and writing the same into said memory means.

2. The medication dispenser of claim 1 further comprising settable time display means.

3. The medication dispenser of claim 1 wherein said logic means further comprises means for including in said data signals data representative of elapsed days in a medication regimen being dispensed.

4. The medication dispenser of claim 3 further comprising settable time display means.

5. The medication dispenser of claim 4 wherein said logic means further comprises means for selectively altering the timing of said medication alert signals.

6. The medication dispenser of claim 5 wherein said alert signals altering means comprises means for altering the interval between alert signals, said display means displaying said interval during said altering.

7. The medication dispenser of claim 1 wherein said logic means further comprises means for selectively altering the timing of said medication alert signals.

8. The medication dispenser of claim 7 wherein said alert signals altering means comprises means for altering the interval between alert signals, said display means displaying said interval during said altering.

9. The medication dispenser of claim 1 wherein a plurality of medications are independently housed, the improvement wherein said medication access signal providing means comprises separate means for providing a medication access signal when access to at least some of said medications is obtained.

* * * * *